US005860639A

United States Patent [19]

Fraser

[11] Patent Number: 5,860,639

[45] Date of Patent: Jan. 19, 1999

[54] CLAMP

[75] Inventor: Ian Fraser, Codicote, England

[73] Assignee: HMC-Brauer Limited (UK Corp)

[21] Appl. No.: 787,760

[22] Filed: Jan. 28, 1997

[51] Int. Cl.[6] ..... B25B 5/08

[52] U.S. Cl. ..... 269/236; 269/229

[58] Field of Search ..... 269/236, 216, 269/217, 229, 233, 204, 198, 199, 136, 139, 24

[56] References Cited

U.S. PATENT DOCUMENTS

| | | | |
|---|---|---|---|
| 345,636 | 7/1886 | Hunter | 269/236 |
| 889,842 | 6/1908 | Arnold | 269/236 |
| 2,153,998 | 4/1939 | Verderber et al. | 269/236 |
| 2,236,439 | 3/1941 | McKenna | 269/229 |
| 2,815,052 | 12/1957 | Krasnow | 269/236 |
| 3,159,393 | 12/1964 | Villano | 269/236 |
| 4,475,726 | 10/1984 | Smith | 269/236 |
| 5,005,813 | 4/1991 | Lawrence | 269/236 |

FOREIGN PATENT DOCUMENTS

| | | |
|---|---|---|
| 24890/67 | 1/1970 | Australia . |
| 385287 | 3/1931 | United Kingdom . |
| 744064 | 2/1956 | United Kingdom . |
| 932218 | 7/1963 | United Kingdom . |
| 952112 | 3/1964 | United Kingdom . |
| 1559876 | 1/1980 | United Kingdom . |

OTHER PUBLICATIONS

Data Sheet 2331—Halder norm+technick—Down–thrust Clamps HWN 331 (Jun. 1994).

*Primary Examiner*—David A. Scherbel
*Assistant Examiner*—Lee Wilson
*Attorney, Agent, or Firm*—Leo Zucker

[57] ABSTRACT

A clamp for clamping a workpiece comprises a base member, a clamping member mounted on the base member for limited linear and rotational movement relative thereto and a drive member mounted on the base member for rotational movement relative thereto. First and second cam elements are provided on the drive member and the clamping member and arranged such that relative rotation of the drive member and the clamping member produces relative linear movement thereof. The clamp includes a lost motion mechanism whereby rotation of the drive member can produce limited rotational movement of the clamping member without causing linear movement thereof.

10 Claims, 5 Drawing Sheets

CLAMP

BACKGROUND OF THE INVENTION

1. Field of the Invention

The present invention relates to a clamp. In particular, but not exclusively, the invention relates to a down-thrust clamp for clamping a workpiece to a machine tool, or for clamping a workpiece in a jig or a mould.

2. Discussion of the Known Art

An example of a down-thrust clamp is that sold by Halder Norm+Technik under the model number 2331. This clamp has a clamping jaw that can be swung through 360° to allow the workpiece to be changed. The clamp is applied by means of a handle that has an eccentric cam, which bears on the upper surface of the clamping jaw.

The clamp described above has the disadvantage that in order to apply the clamp, two separate movements are required: first the clamping jaw has to be swung into position above the workpiece, the position being determined by the user and is not automatically repeatable, and second, the handle has to be pressed downwards to bring the clamping jaw into clamping engagement with the workpiece. This can be very time consuming if a large number of clamps are being used. Further, the stroke of the clamp is rather limited, with the result that variations in the thickness of the workpiece cannot easily be accommodated.

If the clamp is incorrectly adjusted with the result that the eccentric cam reaches the end of its travel, this might give the impression that the clamp is fully applied when, in fact, it is not. This might lead to a risk of the workpiece becoming loose during a machining operation.

SUMMARY OF THE INVENTION

It is an aim of the present invention to provide a clamp that mitigates at least some of the above-mentioned disadvantages.

According the invention, a clamp for clamping a workpiece includes a base member, a clamping member mounted on the base member for limited relative rotational movement about an axis of rotation and limited linear movement in the direction of the axis of rotation. A drive member is mounted on the base member for relative rotational movement about the axis of rotation, and first and second cam elements on the drive member and the clamping member convert relative rotation of the drive member and the clamping member into relative linear movement of said members. The clamping member includes an arm that extends radially with respect to the axis of rotation and has a workpiece-engaging portion at an outer end of the arm for exerting a clamping force on a workpiece in the direction of the axis of rotation. The clamp also has a lost motion mechanism, wherein rotation of the drive member from a first position to a second position causes rotation of the clamping member, and rotation from the second position to a third position causes linear movement of the clamping member.

The present invention makes it possible to swing the clamping member into a pre-determined position and to apply the clamp simply by rotating the drive member. Only a single movement of the drive member is therefore required to apply or release the clamp.

Advantageously, the arrangement is such that rotation of said drive member from a first position to a second position causes rotation of said clamping member, and rotation from said second position to a third position causes linear movement of said clamping member. Said first, second and third positions of said drive member may lie in a single plane of rotation. Swinging the clamping member into position and applying the clamp thus requires only a single, continuous movement.

Advantageously, at least one of said first and second cam elements comprises a face cam. The use of a face cam ensures that the cam elements are always in compression, which allows for the application of a very high clamping force. The clamp is thus extremely robust and the use of a mallet to apply the clamping force is permissible.

Further, it is possible to form the face cams integrally with the drive member and the clamping member or the base member, for example by investment casting. This makes the clamp very simple and inexpensive to manufacture and assemble.

The first and the second cam elements preferably comprise matching face cams. This maximises the contact area of the cam elements, this reducing friction and minimising wear on the cam surfaces.

The clamp may include a resilient member arranged to oppose linear movement of the clamping element in a first direction. The resilient member, which may be a spring, ensures rapid return of the clamping element when the clamp is released. The resilient member advantageously biasses said drive member and said clamping member towards one another.

Advantageously, the first and the second cam elements are arranged to permit continuous rotation of said drive member in a first direction of rotation. This prevents the clamp from being damaged by any attempt to force the handle beyond a fixed stop. If the handle is rotated beyond the point corresponding to maximum travel of the cam elements, which is indicated by alignment of marks on the clamping element and the drive member, the clamp is released and incomplete clamping is indicated audibly and visually.

The cam elements may include stop surfaces to limit rotation of said drive member in a second direction of rotation. This ensures that the drive member always returns to the same position when the clamp is released.

The drive member may include a handle for manual rotation thereof.

The clamping member may include a substantially radially-extending arm having a workpiece-engaging portion at the outer end thereof.

The base member, the clamping member and the drive member advantageously comprise metal castings.

According to the present invention there is further provided a clamp for clamping a workpiece, the clamp comprising a base member, a clamping member mounted on the base member for limited linear and rotational movement relative thereto, and a drive member mounted on the base member for rotational movement relative thereto, the arrangement being such that rotation of the drive member from a first position to a second position causes rotation of said clamping member, and rotation of said drive member from said second position to a third position causes linear movement of said clamping member.

At least one of said cam elements may include at least two portions of different pitch. This enables the clamp to provide a fast initial linear travel followed by a high clamping force, the cam providing the clamping force having a pitch such that the clamp does not release itself. A cam mechanism having two portions of different pitch is described in the applicant's co-pending British patent application No. 950, 895,1.2, filed Nov. 13, 1996, the contents of which are incorporated herein by reference.

An embodiment of the invention will now be described, by way of example, with reference to the accompanying drawings and the appended claims.

DETAILED DESCRIPTION OF THE INVENTION

An embodiment of a clamp, which may be termed a swing-arm clamp, is shown in FIGS. 1 to 4. The clamp comprises a base 1, an arm 2 and a drive member 3. The arm 2 and the drive member 3 are both mounted for rotation on the base 1.

Figure 1:
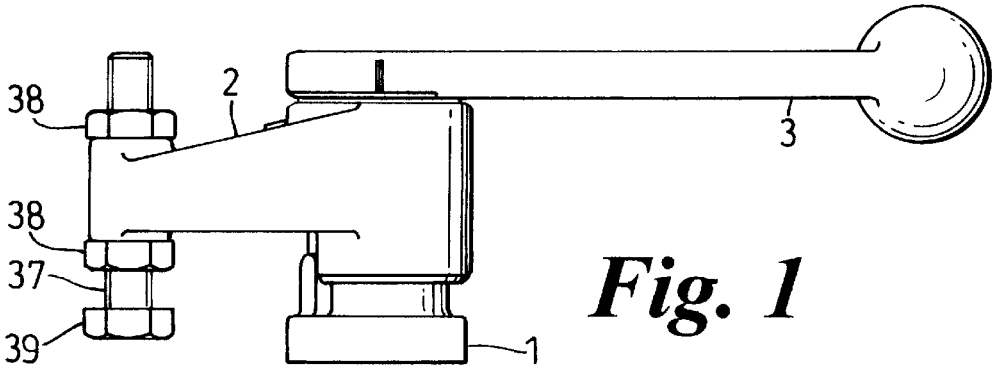
FIG. 1 is a side view of a clamp according the invention.
Figure 2:
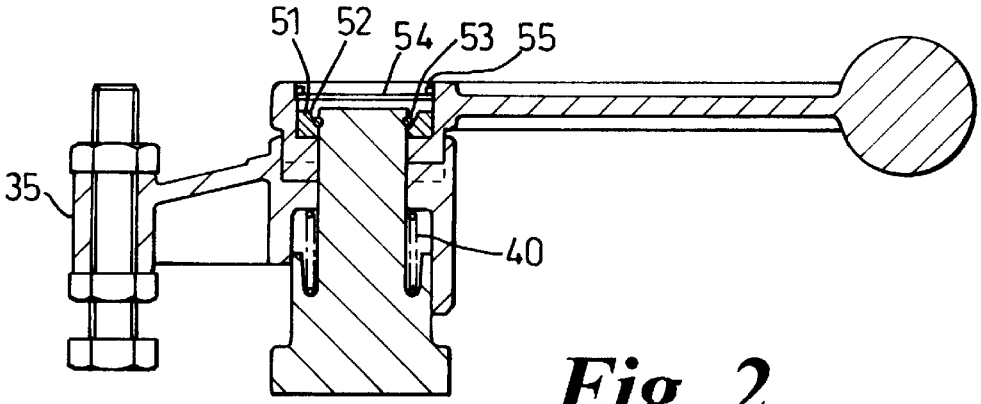
FIG. 2 is a side view of the clamp partly in cross-section.
Figure 3:
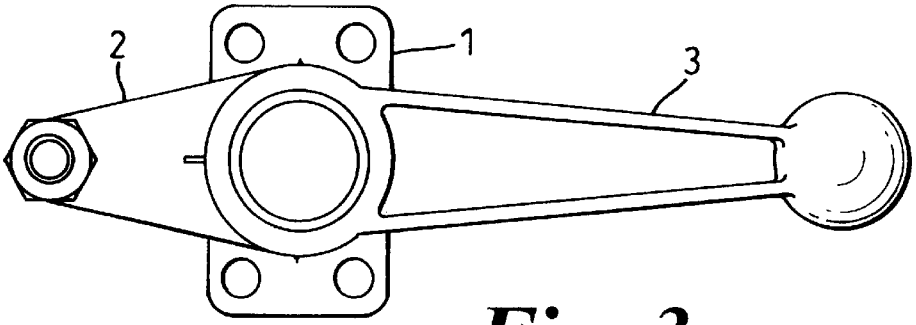
FIG. 3 is a top view of the clamp.
Figure 4:
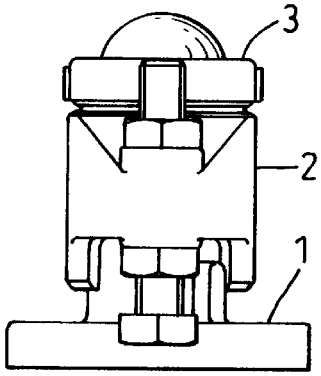
FIG. 4 is a front view of the clamp.
Figure 5:
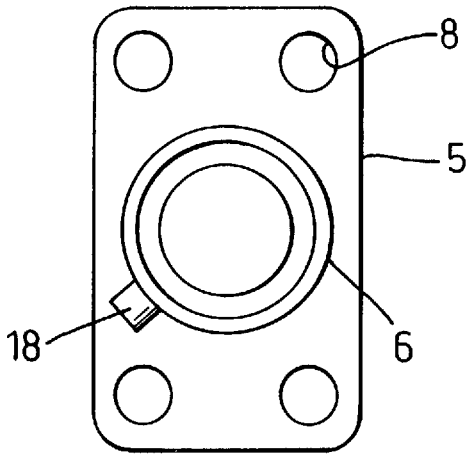
FIG. 5 is a top view of the base.
Figure 6:
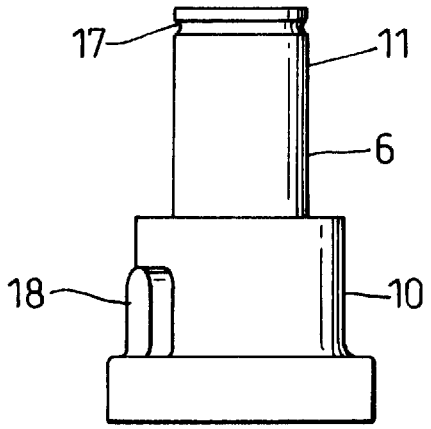
FIG. 6 is a side view of the base.
Figure 7:
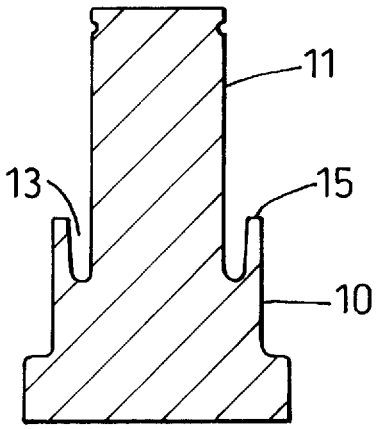
FIG. 7 is a side view of the base in cross-section.
Figure 8:
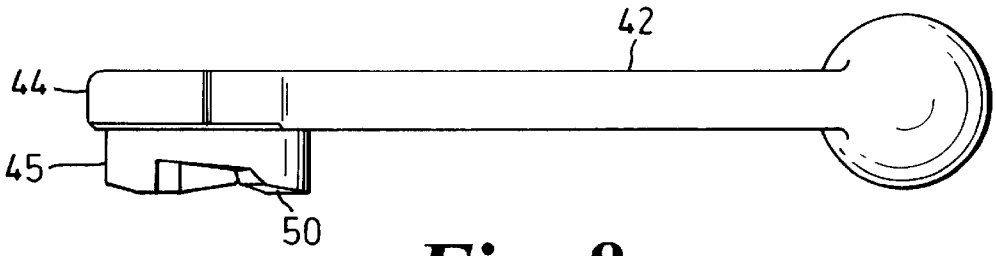
FIG. 8 is a side view of the drive member.
Figure 9:
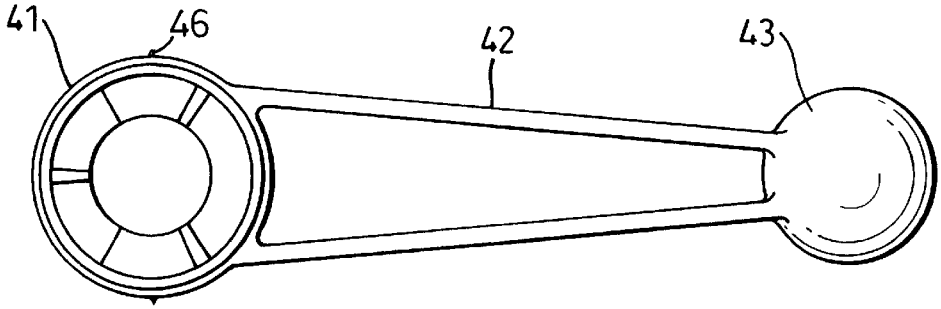
FIG. 9 is a bottom view of the drive member.
Figure 10:
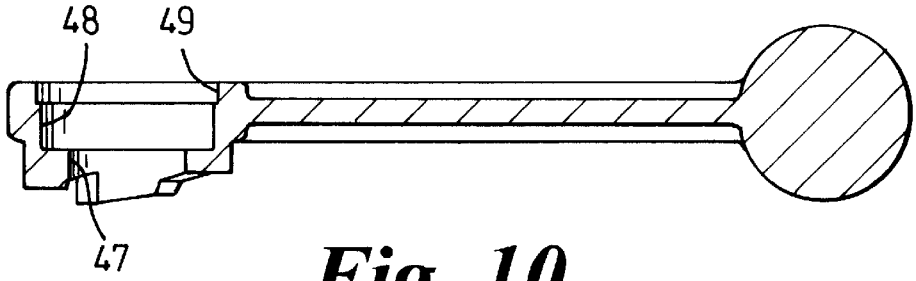
FIG. 10 is a side view of the drive member partly in cross-section.

The base 1, which is shown in more detail in FIGS. 5 to 7, comprises a substantially rectangular base plate 5 and a substantially cylindrical body member 6 that extends perpendicularly to the plane of the base plate 5. Four holes 8 are provided in the base plate 5, one adjacent each corner, which receive bolts for mounting the clamp in use on a machine tool, a jig or a mould.

The cylindrical body member 6 comprises a lower portion 10 of radius $r_1$ and an upper portion 11 of radius $r_2$, where $r_1>r_2$. An annular groove 13 is provided in the upper face of the lower portion 10, which extends the middle portion 11 downwards into the lower portion 10 to approximately half the depth of the lower portion. The upper part of the lower portion 10 thus forms an upstanding collar 15.

A circumferential groove 17 is provided in the cylindrical surface of the upper portion 11, towards the upper end thereof. A stop member 18 extends radially outwards from the cylindrical surface of the lower portion 10 and upwards from the base plate 5, to approximately half the height of the lower portion 10.

The arm 2, which is shown in more detail in FIGS. 12 to 15, comprises a substantially cylindrical body member 19 and an arm member 20 that extends substantially radially therefrom. A cylindrical bore extends axially through the body member 19 and comprises a lower portion 21 of radius $r_3$ that is slightly larger than $r_1$, a middle portion 22 of radius $r_4$ that is slightly larger than $r_2$ and an upper portion 23 of radius $r_5$. The body member 19 thus comprises a lower section in the form of a skirt 24, a middle section that includes an inwardly-extending circular flange 25 and an upper section in the form of an upstanding circular collar 26.

The skirt 24 includes a cut-out portion 27 that extends through an arc of approximately 90° to approximately half the height of the skirt. The two vertical edges of the cut-out portion provide stop surfaces 28 that, in use, abut the stop member 18 to limit rotation of the arm 2 relative to the base 1.

Figure 16:
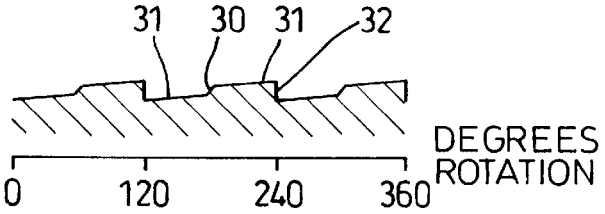
FIG. 16 is a schematic representation of the profile of the clamping member cam surface.

The inwardly-extending flange 25 has an upper face that is shaped to provide a cam surface 29 in the form of a face cam. The profile of the cam surface 29 is shown in FIG. 16 and comprises three identical equi-angularly spaced portions, each of which includes a constant high pitch section 30 and on either side thereof a constant low pitch section 31. In the embodiment shown in the drawings, the constant high pitch section extends through an arc of approximately 10° and has a pitch at the outer edge of the cam of approximately 45°, producing a linear travel of 2.5 mm. The constant low pitch section extends through an arc of approximately 110° producing a linear travel also of 2.5 mm. The ends of adjacent portions of the cam surface 29 are connected by substantially vertical walls that form stop surfaces 32.

The arm member 20 is in the form of a tapered ∩-shaped beam comprising two side members 33 and an upper member 34, and extends substantially radially from the body member 19. At the remote end of the arm member 19 there is provided a hollow cylindrical member 35, the longitudinal axis of which is parallel to the longitudinal axis of the body member 19. The arm member 20 is aligned with the cut-out portion 27 of the body member and includes on the upper member 34 an index mark 36 that is aligned with the longitudinal axis of the arm member.

A set screw 37 (shown in FIGS. 1 to 4) extends through the bore of the cylindrical member 35 and is secured in position by nuts 38 that engage the upper and lower ends of the cylindrical member 35. In use, the head 39 of the set screw 37 engages the workpiece. Workpieces of different thicknesses may be accommodated by adjusting the nuts 38.

The arm 2 is mounted for rotation on the base 1, with the cylindrical body member 6 of the base extending through the bore of the arm body member. Rotational travel of the arm is limited to an arc of approximately 80° by engagement of the stop surfaces 28 with the stop member 18.

A compression spring 40 is seated within the groove 13 in the base 1 and abuts the lower surface of the flange 25 of the arm 2. The spring 40 serves to bias the arm 2 axially upwards relative to the base 1.

The drive member 3, which is shown in more detail in FIGS. 8 to 11, comprises a substantially cylindrical body member 41 and a handle member 42 that extends substantially radially therefrom. The handle member 42 has an H-shaped cross-section and tapers towards its remote end. At the remote end of the handle member 42 there is provided a hand grip in the form of a spherical ball 43.

The handle body member 41 comprises an upper portion 44 and a lower portion 45 of smaller radius $r_6$. The radius $r_6$ or the lower portion 45 is slightly less than the radius $r_5$ of the arm member bore upper portion 23. An index mark 46 is provided on the cylindrical surface of the upper portion 44, at a point displaced at an angle of 90° to the longitudinal axis of the handle member 42.

A cylindrical bore extends through the handle body member 41, the bore comprising a lower portion 47 having a radius $r_7$ substantially equal to the radius $r_4$ of the arm member bore middle portion 22, a middle portion 48 of radius $r_8$ and an upper portion 49 of radius $r_9$, where $r_9>r_3>r_7$.

Figure 11:
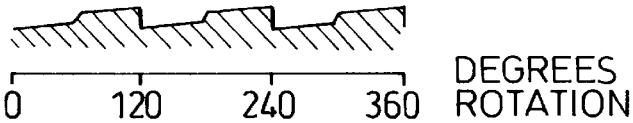
FIG. 11 is a schematic representation of the profile of the drive member cam surface.
Figure 12:
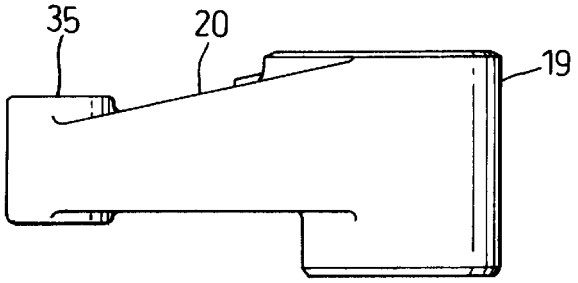
FIG. 12 is a side view of the clamping member.
Figure 13:
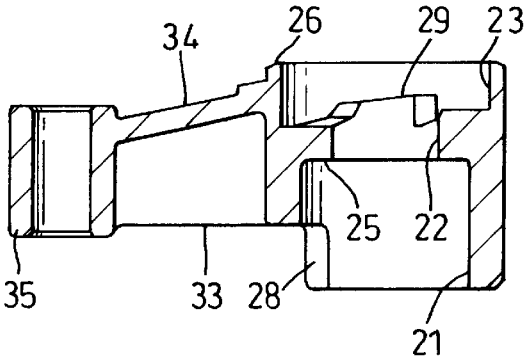
FIG. 13 is a side view of the clamping member in cross-section.
Figure 14:
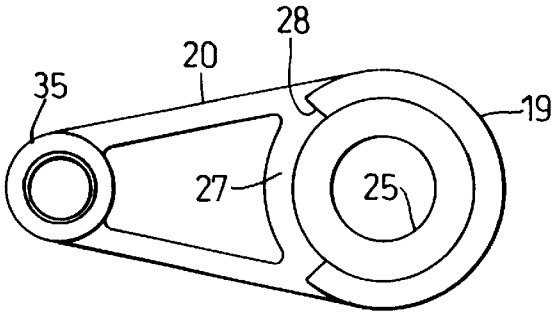
FIG. 14 is a bottom view of the clamping member.
Figure 15:
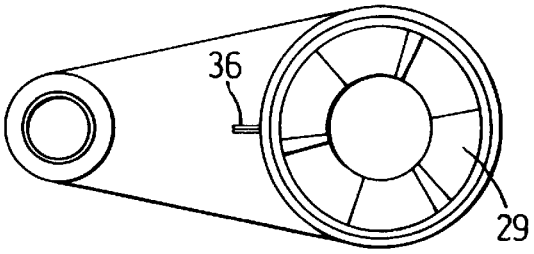
FIG. 15 is a top view of the clamping member.

The lower surface of the handle body member 41 is formed as a cam surface 50. The profile of the cam surface 50 is shown in FIG. 11 and is matched to that of the arm member cam surface 29.

The drive member 3 is mounted for rotation on top of the arm 2, with the upper part of the middle portion 11 of the base body member 6 extending through the bore 47, 48 49. The cam surfaces 29, 50 of the arm 2 and the drive member 3 engage one another.

A cylindrical collar 51 having a radius $r_{10}$ that is very slightly less than the radius $r_8$ of the drive member bore middle portion 48 is seated on top of the drive member 3. The collar 51 has a tapered bore 52, the radius $r_{11}$ of the smaller, lower end of which is very slightly larger than the radius $r_2$ of the base body upper portion 11.

A circlip 53 is seated within the annular groove 17 in the base body upper portion 11 and sits slightly proud of the cylindrical surface of the upper portion. The circlip 53 engages the bevelled surface of the tapered bore 52 and so retains the collar 51 in position. A cover place 54 is seated within the drive member bore upper portion 49 and retained by a second circlip 55.

The base 1, the arm 2 and the drive member 3 are all manufactured from alloy steel, for example nickel carbon steel, by investment casting (e.g. by lost wax casting). Precision casting techniques are employed, providing tolerances of ±0.005" per inch (±0.12 mm per 25 mm). This precision allows the parts to be assembled with almost no machining. The castings are case hardened to provide a high surface hardness for the cams and a tough core for compressive strength. The castings are finished with manganese phosphate, which provides corrison resistance. The collar 51 is machined from nickel carbon steel barstock and is case hardened and finished with manganese phosphate.

Figures 17, 18, 19:
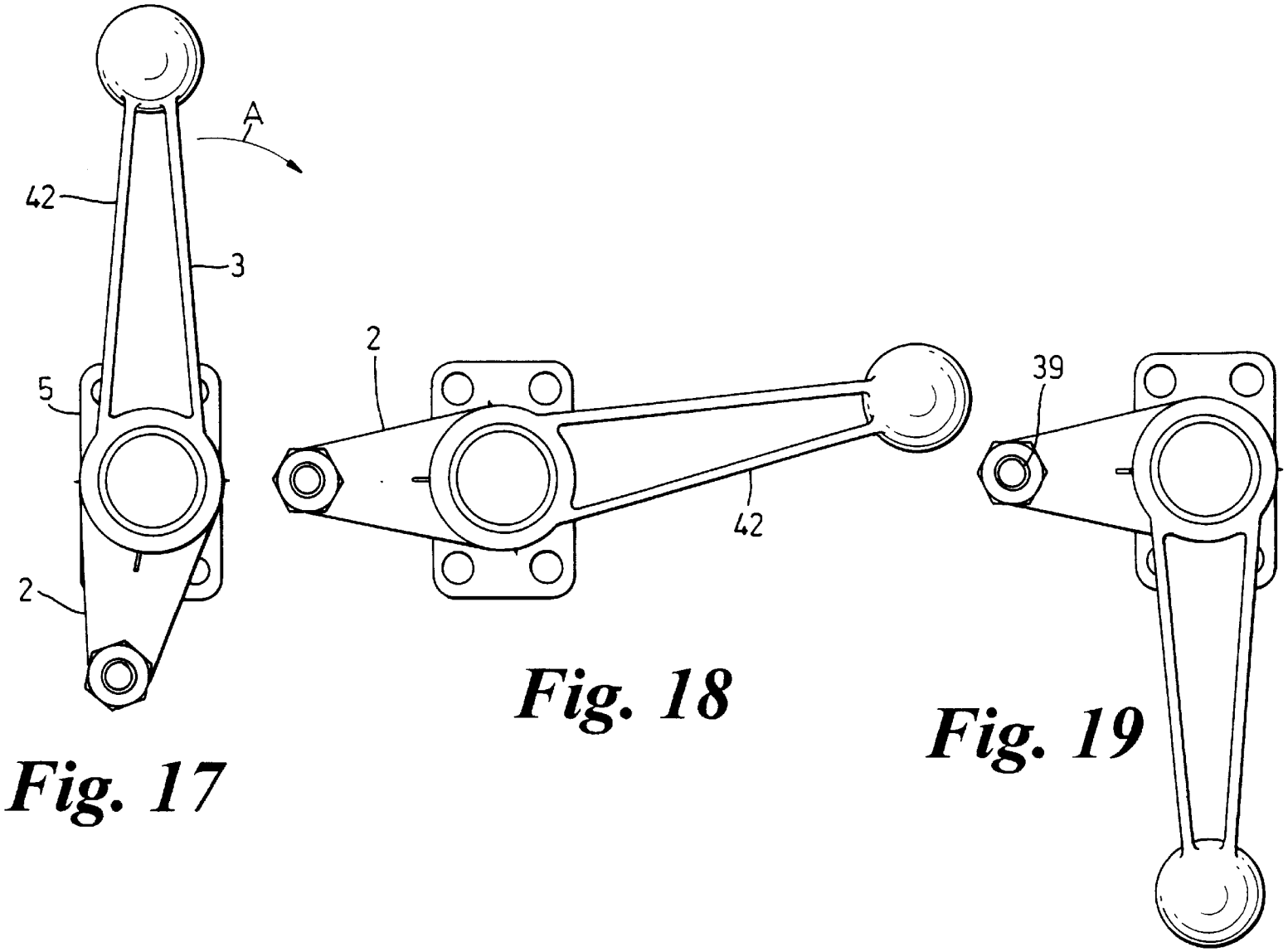
FIG. 17 is a top view of the clamp in a released and retracted position.
FIG. 18 is a top view of the clamp in a partially applied position.
FIG. 19 is a top view of the clamp in a full applied position.

Operation of the clamp will now be described. In the rest position as shown in FIG. 17, the drive member 3 and the arm 2 are approximately aligned with one another and with the longer edges of the base plate 5. Anti-clockwise rotation of the handle 42 from this position is prevented by the engagement of one of the arm stop surfaces 28 with the base stop 18, and of the corresponding vertical portions 32 of the two cam surfaces 29, 50. In this position, the arm 2 is clear of the required position of the workpiece, which allows the workpiece to be placed in position.

As the handle 42 is rotated clockwise (in the direction of the arrow A) , the arm is also caused to rotate, owing to the fact that the respective cam surfaces 29, 50 of those two parts are urged towards one another by the compressed spring 40. The arm is thus swung into position above the workpiece that is to be clamped as shown in FIG. 18.

When the arm 2 has rotated through approximately 80°, the other stop surface 28 engages the base stop 18, preventing further rotation of the arm 2. Continued rotation of the handle then causes the cam surfaces 29, 50 to ride over one another, driving the arm 2 downwards cowards the base place 5 as shown in FIG. 19. The workpiece is thus clamped securely in position by the set screw 39. The pitch of the cam surfaces is such that the clamp does not release itself.

The clamping force exerted on the workpiece is, of course, dependent on the force applied to the drive member 3. The clamp is designed to be able to withstand the use of a mallet to apply and release the clamp.

If the clamp is over tightened, or if the set screw 39 is incorrectly adjusted so that the required clamping force cannot be provided within the travel of the cam surfaces, there is the possibility that the clamp may be tightened to such an extent that the cam surfaces are left at the very limit of their travel. Such a situation is potentially dangerous since it is possible that cams could slip over onto the next surface, thereby releasing the clamp.

In order to reduce this danger, the limit of acceptable tightening is indicated by the alignment of the index marks 36, 46 on the arm 2 and the drive member 3.

The clamp is released by rotating the drive member 3 in the anti-clockwise direction (opposite the arrow A). Initial rotation of the drive member causes relative movement of the cam surfaces and so releases the clamping force, the arm 2 being lifted clear of the workpiece by the compressed spring 40. Further rotation of the drive member 3 swings the arm clear of the workpiece, allowing it to be removed. The final rest position of the arm and the drive member is determined the engagement of the stops 28, 18.

As will be apparent from the above description, the clamp can be applied and released with only single movements of the drive member 3. The clamp is therefore very quick and easy to use.

Various modifications of the clamp are envisaged. For example, the mutually engaging cam surfaces 29, 50 may be provided on the base 1 and the drive member 3, instead of the arm 2 and the drive member 3. The relative positions of the arm 2 and the drive member 3 with respect to the base 1 may also be reversed, so that rotation of the drive member 3 lifts the arm 2 rather than driving it downwards.

Whilst the profile of the cam surfaces 29, 50 that is described above is preferred, it is envisaged that the cam surfaces may take other forms: for example, the pitch and the length of the constant pitch section may be varied, and the number of cam sections may be increased or decreased. It is, however, important that the pitch of the cam surface is large enough to produce sufficient axial travel, whilst being small enough to produce the required clamping force and to prevent the clamp releasing itself. The direction of the cam surfaces may also be reversed, to provide anti-clockwise clamping.

I claim:

1. A clamp for clamping a workpiece, the clamp comprising a base member, a clamping member mounted on the base member for limited rotational movement relative thereto about an axis of rotation and limited linear movement in the direction of said axis of rotation, a drive member mounted on the base member for rotational movement relative thereto about said axis of rotation, and first and second cam elements provided on the drive member and the clamping member for converting relative rotation of the drive member and the clamping member into relative linear movement thereof, said clamping member including an arm that extends substantially radially with respect to said axis of rotation, said arm having a workpiece-engaging portion at an outer end thereof for exerting a clamping force on a workpiece substantially in the direction of said axis of rotation, the clamp including a lost motion mechanism, whereby rotation of the drive member from a first position to a second position causes rotation of said clamping member, and rotation from said second position to a third position causes linear movement of said clamping member.

2. A clamp according to claim 1, in which said first, second and third positions of said drive member lie in a single plane of rotation.

3. A clamp according to claim 1, in which at least one of said first and second cam elements comprises a face cam.

4. A clamp according to claim 3, in which said first and second cam elements comprise matching face cams.

5. A clamp according to claim 1, including a resilient member arranged to oppose linear movement of the clamping element in a first direction.

6. A clamp according to claim 5, in which said resilient member biasses said drive member and said clamping member towards one another.

7. A clamp according to claim 1, wherein said first and second cam elements are arranged to permit continuous rotation of said drive member in a first direction of rotation.

8. A clamp according to claim 1, wherein said cam elements include stop surfaces to limit rotation of said drive member in a second direction of rotation.

9. A clamp according to claim 1, wherein said drive member includes a handle for manual rotation thereof.

10. A clamp according to claim 1, wherein the base member, the clamping member and the drive member comprise metal castings.

* * * * *